US006244205B1

(12) United States Patent
Saccocio

(10) Patent No.: US 6,244,205 B1
(45) Date of Patent: Jun. 12, 2001

(54) STOWABLE BOW PLATFORM

(76) Inventor: Seth Stucker Saccocio, 780 W. Tropical Way, Plantation, FL (US) 33317

( * ) Notice: Subject to any disclaimer, the term of this patent is extended or adjusted under 35 U.S.C. 154(b) by 0 days.

(21) Appl. No.: 09/387,951

(22) Filed: Sep. 1, 1999

Related U.S. Application Data

(60) Provisional application No. 60/098,901, filed on Sep. 2, 1998.

(51) Int. Cl.[7] ..... B63B 17/00

(52) U.S. Cl. ..... 114/343; 114/201 R; 114/364

(58) Field of Search ..... 114/255, 343, 114/364, 201 R, 188; 108/11, 44, 158

(56) References Cited

U.S. PATENT DOCUMENTS

| | | | | |
|---|---|---|---|---|
| 3,724,595 | * | 4/1973 | Green | 182/118 |
| 4,229,858 | * | 10/1980 | Baxter et al. | 17/44 |
| 4,489,028 | * | 12/1984 | Masters | 114/347 |
| 4,811,680 | * | 3/1989 | Genth | 114/201 R |
| 5,860,367 | * | 1/1999 | Riegel et al. | 108/26 |
| 6,016,756 | * | 1/2000 | McMahon et al. | 108/158 |

* cited by examiner

*Primary Examiner*—Sherman Basinger
(74) *Attorney, Agent, or Firm*—R. M. Saccocio

(57) ABSTRACT

A platform for a boat including a top member, removable leg members and apparatus for storing the leg members to an underside of the top member when the legs are removed. A compact package results, which is readily storable in a hatch of a boat. The platform is readily assembled, attached to the boat, and then disassembled and stored.

9 Claims, 5 Drawing Sheets

STOWABLE BOW PLATFORM

CROSS REFERENCE TO RELATED APPLICATIONS

This application claims the benefits of U.S. Provisional Application Ser. No. 60/098,901 filed Sep. 2, 1998.

BACKGROUND OF THE INVENTION

1. Field of the Invention

This invention relates in general to the field of boat platforms and in particular to storable bow platforms for use with a fishing boat.

2. Description of the Prior Art

There are types of fishing where it is most advantageous for a fisherman to stand on a raised platform on a boat. The added height gives a fisherman the ability to actually see the fish in the water for longer distances. Flats fishing for bonefish is one such example. However, bonefishing is not a sport where a cast is made in the hopes that a fish is present in the general location of the cast. The fisherman needs to see bonefish in the water in order to make a cast at the exact location of the fish.

When fishing for bonefish, a specially rigged boat is used. They are generally called flats boats. They consist of a sixteen to twenty foot boat which is able to float in shallow water having a depth of approximately two to four feet. A platform is permanently mounted at the boat's stern directly above the boat's motor. The stern platform is used by the captain to "hunt" for bonefish and from which he propels the boat by a long poling rod. The fisherman is located at the boat's bow. Upon seeing a bonefish, the captain directs the fisherman where to cast; however, the ability of the fisherman to actually see the bonefish greatly enhances his ability to catch the fish. As previously stated, a raised platform provides this advantage.

There exist bow platforms in the prior art which comprise integrally assembled components i.e. the legs form part of a welded frame to which a platform is welded. Certainly such platforms perform their function quite adequately; however, they are not without problems. One problem is the inability to store the platform on the boat when the platform is not being used. There simply is no storage space on a flats boat or other small boats which can accommodate a prior art platform. Typically therefore, the prior art platform is left in place on the bow of the boat. This presents a problem of interference. It forms an obstacle which always seems to be in the way of the fisherman when he is not bonefishing. It forms an obstacle when dropping an anchor. It forms an obstacle when using the boat for other types of fishing where a platform has no advantage. It forms an obstacle when attempting to access the boat's bow hatch. Since there are so many instances where a bow platform is disadvantages to a boater and fisherman, the fisherman more often than not, disposes with the use of a platform and simply leaves it off the boat. This, of course, leaves the fisherman without the advantages of a bow platform. The present invention is intended to overcome the disadvantages of the bow platform of the prior art.

SUMMARY OF THE INVENTION

The present invention provides a bow platform which eliminates most of the disadvantages of an integrally made platform. The present invention comprises a bow platform whereby the legs are mounted to the platform but can be quickly and easily removed from the platform. The legs are stored on the underside of the platform resulting in an assembly that is essentially flat and easily storable in a hatch on the boat. The unique construction of the inventive bow platform provides for an extremely sturdy platform having little or no side to side or front to back movement when in use. In another embodiment of the present invention, the bow hatch cover is removable and to which legs are attachable to form the bow platform. After use, the legs are removed, stored under the cover and the cover is reattached to the bow hatch. This embodiment eliminates all storage problems.

The above-stated objects as well as other objects which, although not specifically stated, but are intended to be included within the scope the present invention, are accomplished by the present invention and will become apparent from the hereinafter set forth Detailed Description of the Invention, Drawings, and the claims appended herewith.

In accordance with the above, there has been summarized the more important features of the present invention in order that the detailed description of the invention as it appears in the below detailed description of the same, may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
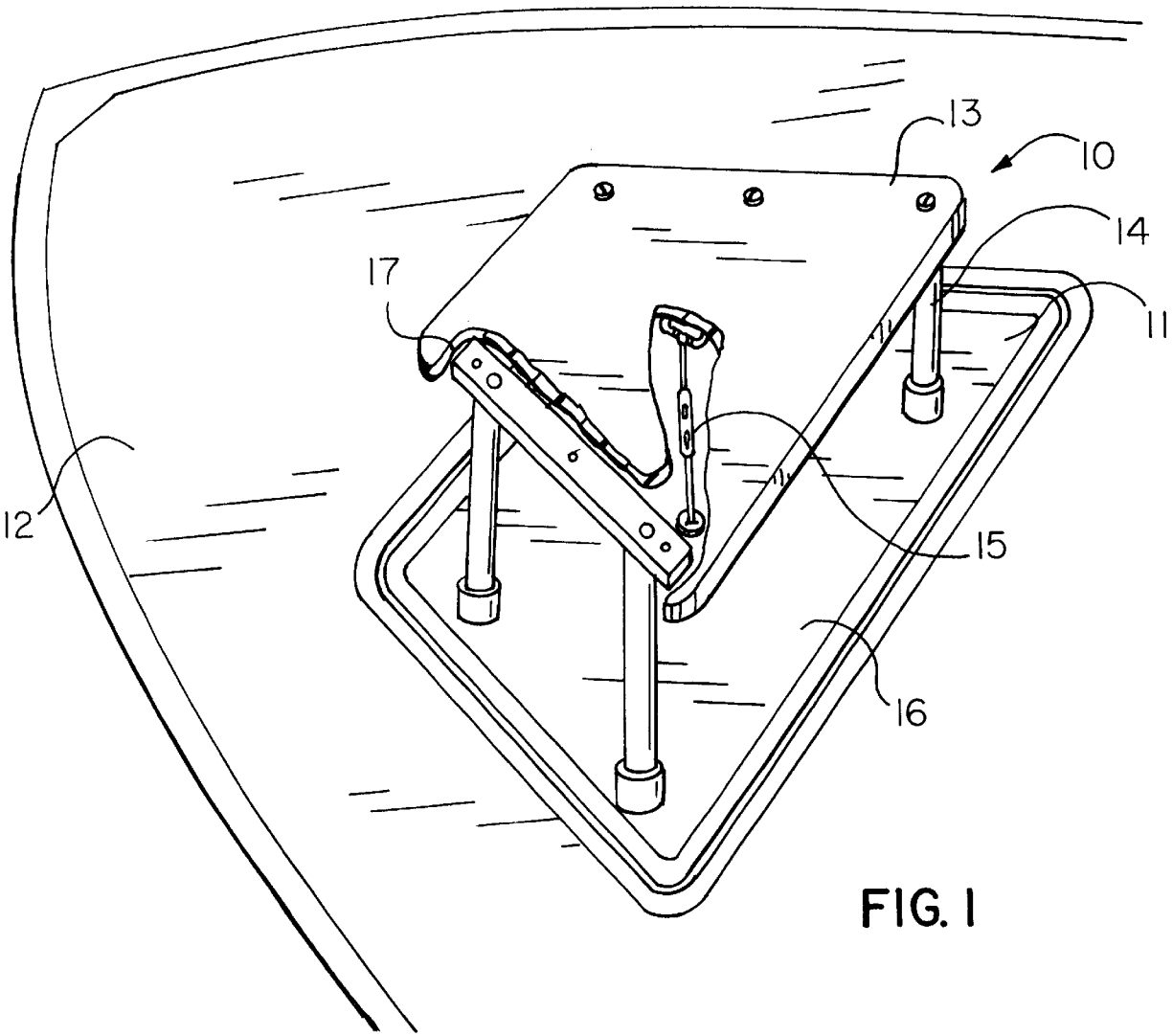
FIG. 1 is an isometric view of one embodiment of the present invention illustrating its attachment to the bow of a boat.

As required, detailed embodiments of the present invention are disclosed herein; however, it is to be understood that the disclosed embodiments are merely exemplary of the invention which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like the characteristics and features of the present invention shown in the various figures are designated by the same reference numerals.

FIG. 1 shows the inventive bow platform 10 in place over the hatch cover 11 of a boat 12. The platform includes a platform top 13, four legs 14, two mounting plates 15 and a hold-down means 24. It is necessary that the attachment of the legs to the platform top be very rigid or sturdy so that the fisherman does not experience wobbling of the platform which will interfere with his casting, and reeling in a fish. Yet the connections of the legs 14 to the platform top 13 must be capable of being accomplished without tools.

In order to provide the necessary rigidity to the platform 10, mounting plates 15 are used which are interconnected between the legs 14 and the platform top 13. This type of construction provides for minimizing the overall weight of the platform by allowing the use of a relatively thin platform top 13 and yet provides for a rigid connection between the legs and the platform top 13. The platform top 13 is preferably trapezoidal in configuration to coincide with the typical shape of a bow hatch cover and/or the pointed bow of a boat; however, any configuration is within the scope of the present invention. Sufficient space is provided around the outside of the platform to allow a person to walk around the platform. While it is preferable that the stowable platform 10 be mounted to the bow hatch cover 16, its location is not limited to this position.

The platform top 13 may be made from a honeycombed construction material 17 for weight purposes. A fiberglass coating may then be used on the top and bottom of the honeycombed material 17 to add stiffness and weatherproofing. The top surface of the platform top 13 may be provided with a non-skid surface.

Figure 2:
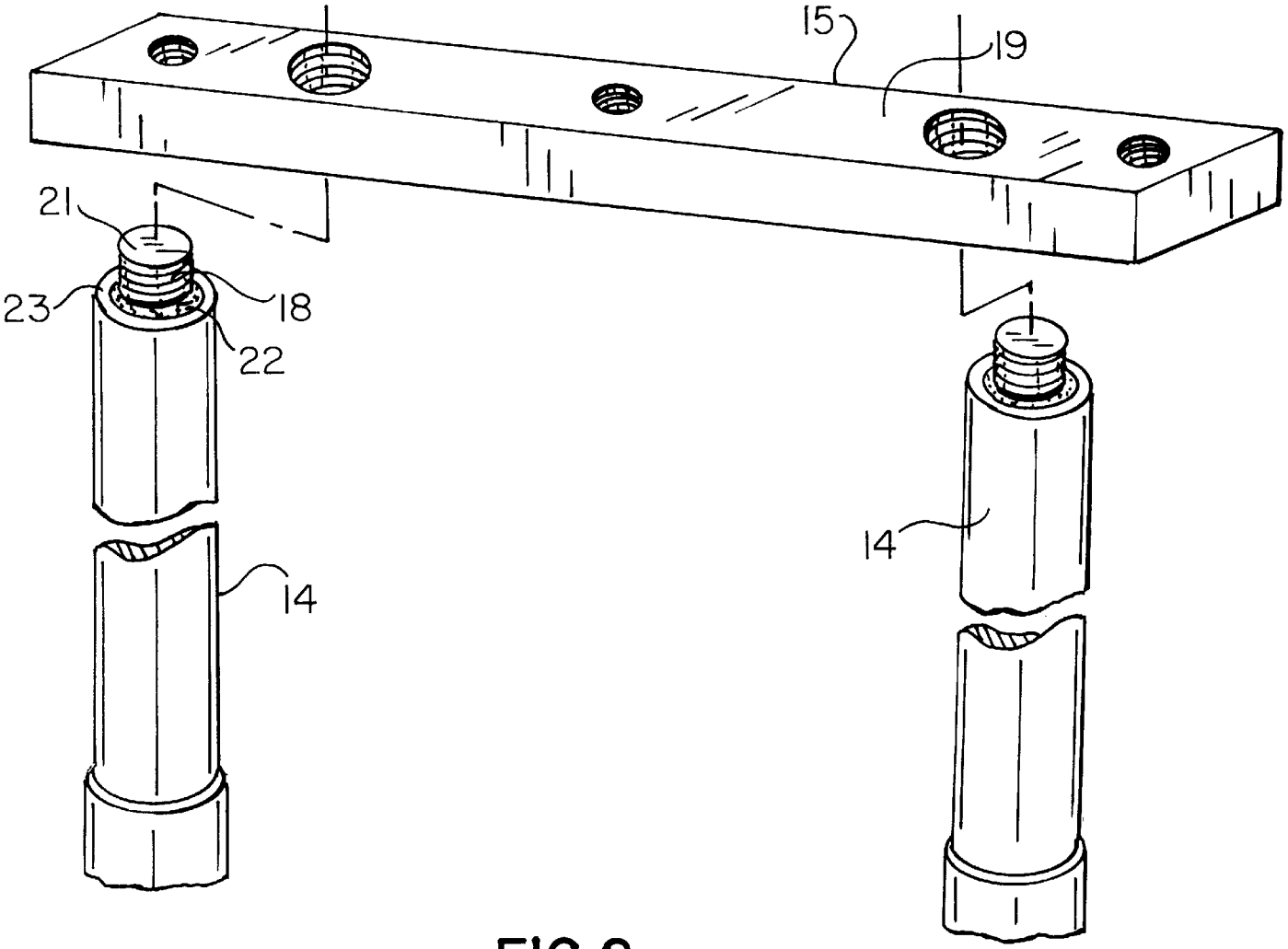
FIG. 2 is an isometric rendering of the arrangement of two legs to a top mounting plate.

FIG. 2 illustrates the connection of two leg members 14 to one mounting plate 15. Each leg 14 is threadingly connectable to the mounting plate 15. The length of the threads 18 on the leg is slightly less than the thickness of the mounting plate 15 so as to prevent the threaded portion 18 from extending above the top surface 19 of the support plate 15. The thickness of the mounting plate. 15, however is to be sufficiently thick so as to assume a rigid threaded connection e.g. ¾ inch. The mounting plate 15 extends along the side length of the platform top 13. This length provides for a flat support surface area of sufficient magnitudes between the top 19 of the support plate 15 and the bottom of the platform top 13 which is essential to preventing any wobble between the platform top and the support plate. A plurality of screws or bolts 20 may also be used to connect the mounting plate 15 to the platform top 13.

FIG. 2 illustrates the construction of a leg member 14. The leg member 14 is made from a hollow tube to provide lightness although a solid rod may also be used. A threaded rod 21 is fitted to one end of the leg member. A somewhat resilient spacer member 22 is fitted between the outer diameter of the threaded rod 21 and the inner diameter of the leg post 14 in order to allow a press fit, however, the space member is not essential. The threaded rod may be directly press fitted into the leg post 14. A relatively large and flat bearing surface 23 is provided at the top of the leg post 14 to assure firm seating of the leg member 14 when threaded into the mounting plate 15. A large bearing area is necessary to prevent wobble between the leg 14 to plate 15 connection using only hand applied force to tighten the connection.

A fully assembled platform 10 is held to the deck or bow hatch cover 16 of the boat 12 by any appropriate attaching means 24. FIG. 1 illustrates the use of one or more turnbuckles attached to threaded rods, or more preferably nylon straps, having quick disconnect, over the center, buckles may be used.

Figure 3:
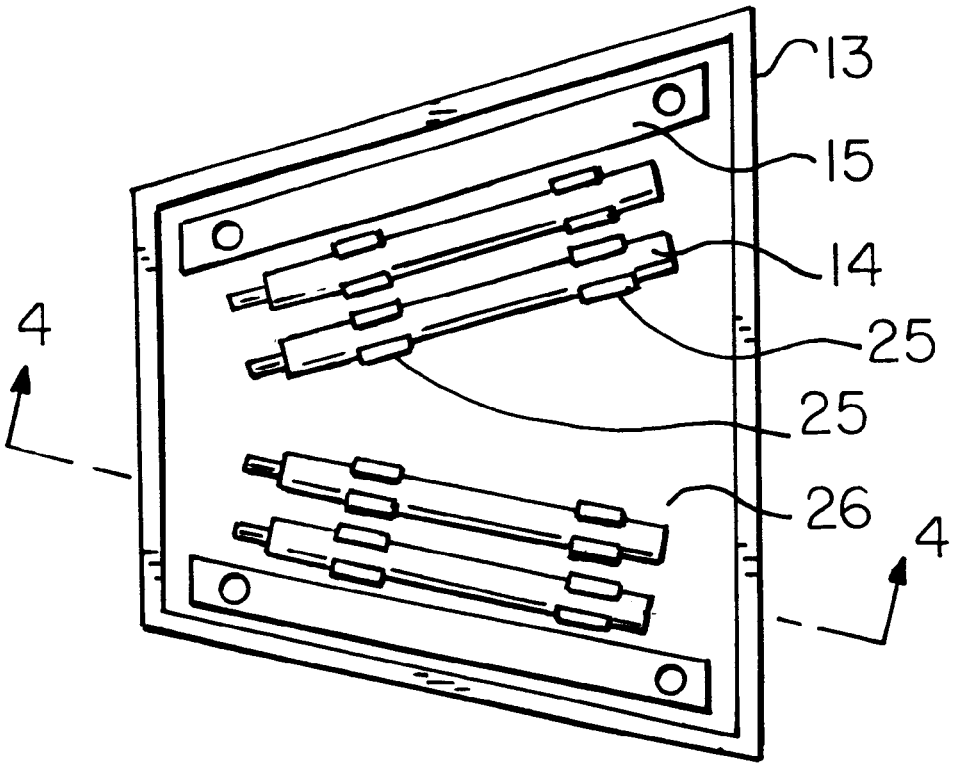
FIG. 3 illustrates a bottom view of a bow platform with the legs attached for storage.
Figure 4:
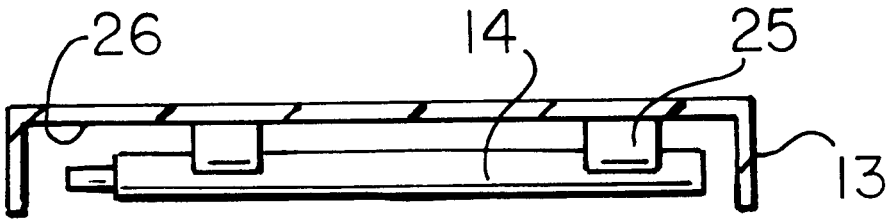
FIG. 4 is a cross sectional view taken along the line 4—4 of FIG. 3.

When the inventive platform 10 is to be removed from the boat deck, the preferred straps 24 are disconnected to free the platform 10 from the deck of the boat 12. Each leg member 14 is then unthreaded by hand and attached by clips 25 to the underside 26 of the platform top 13 as shown in FIGS. 3 and 4. A relatively flat and lightweight structure results which may then be conveniently stored for example, in the bow hatch. Any type of securement means may be used to removably attach the leg members 14 to the underside of the platform top, e.g. straps, bars, recess bolts, spring clips, and other such like devices. Assembly is, of course, the reverse of the disassembly procedure. The relatively large diameter of the leg members 14 also provides the ability to sufficiently hand tighten the leg members 14 to mounting plates 15 to assure a tight wobble free connection.

Figure 5:
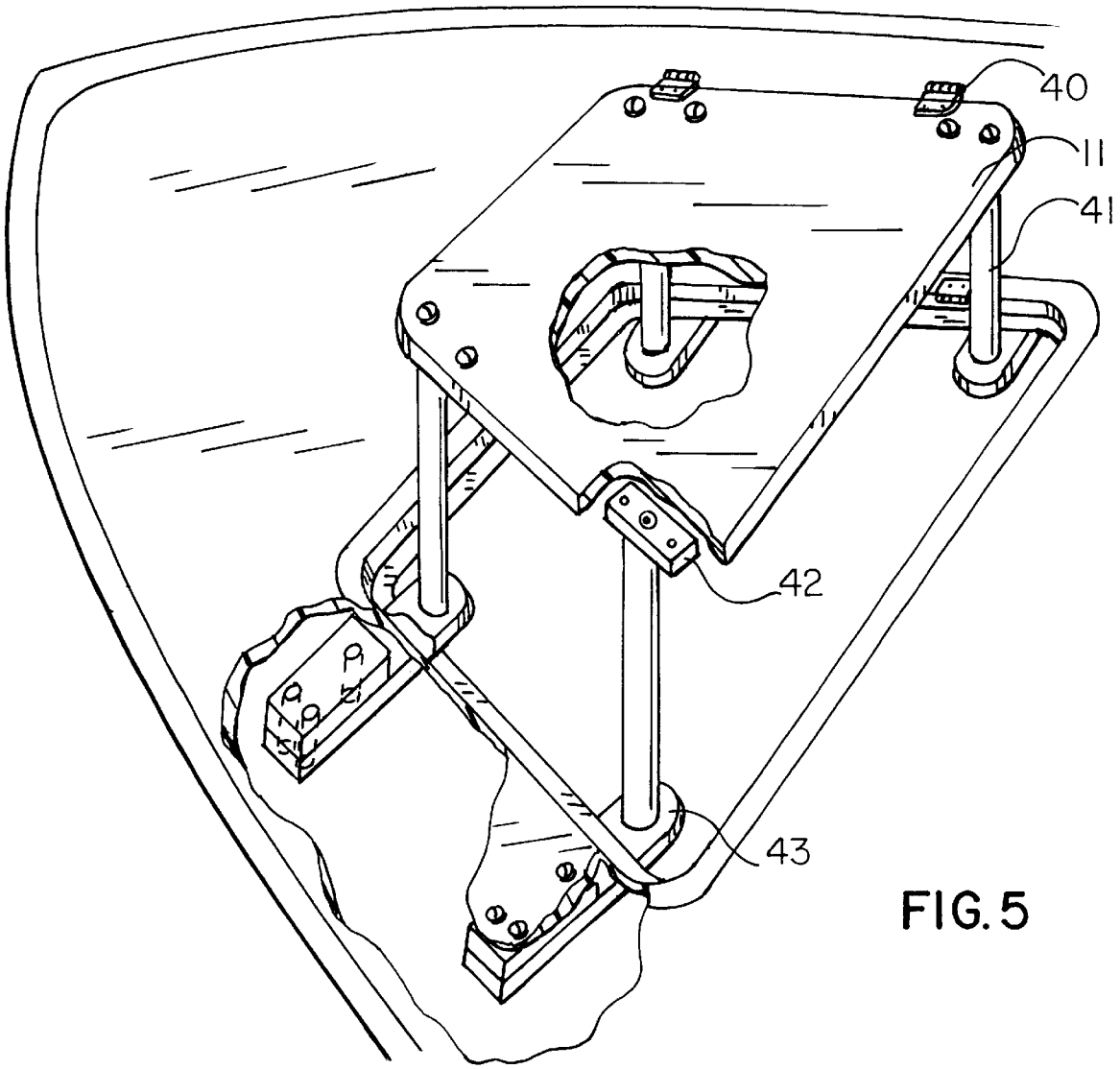
FIG. 5 illustrates another embodiment of the present invention.
Figure 6:
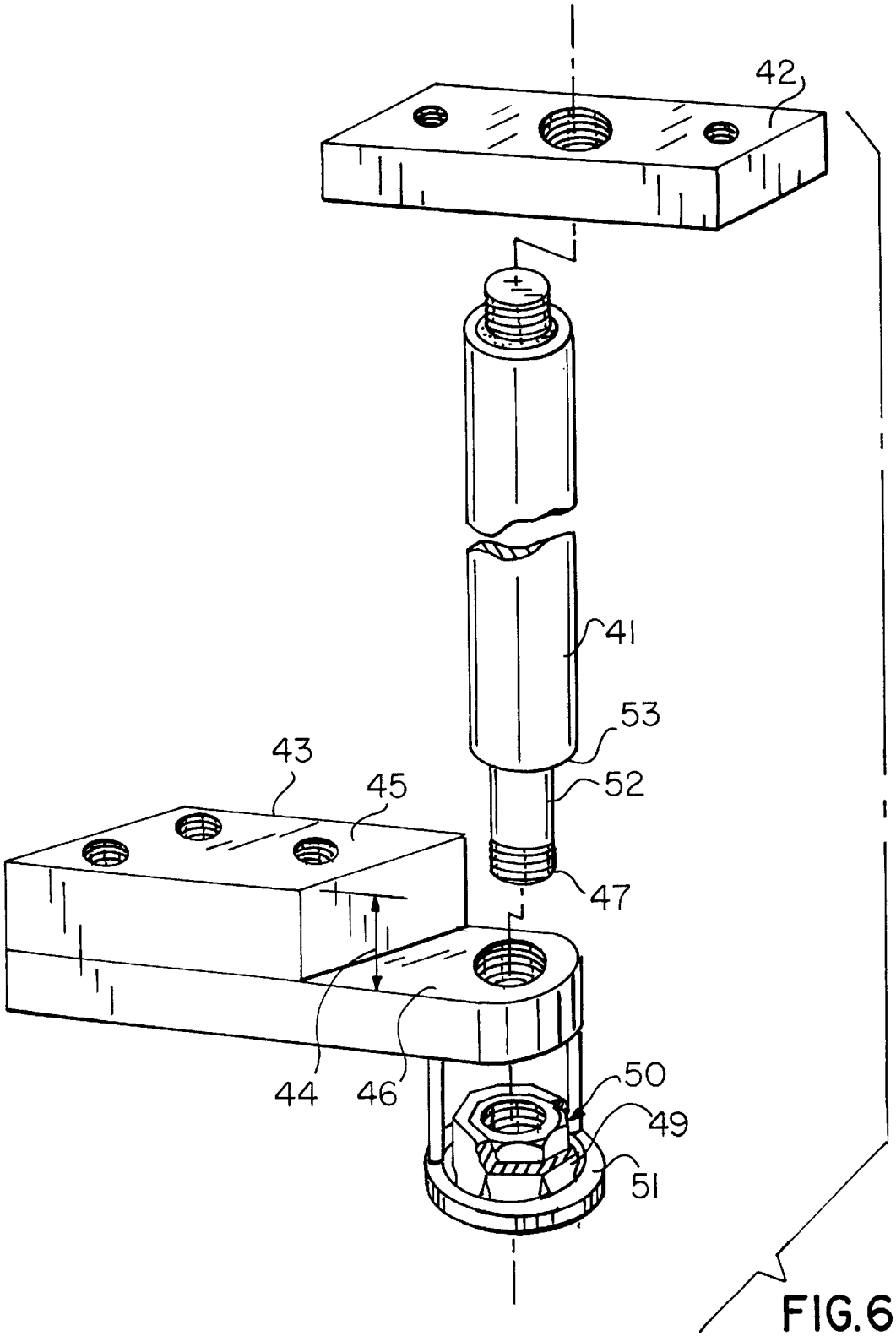
FIG. 6 illustrates one construction of a leg attachment of the embodiment of FIG. 5.

The embodiment shown in FIG. 5 utilizes the bow hatch cover 11 as the platform top. In order to accomplish this, take-apart hinges 40 are used to connect the hatch cover 11 to the hatch opening. The mounting plates 15 of the previous embodiment may be used to connect the leg members 41 to the hatch cover 11 or individual plates 42 may be used. Since the leg members 41 extend within the hatch cover opening, a deck plate 43 must be used at each leg 41 location. The deck plates 43 are attached to the underside of the deck and extend into the hatch opening. Details of the leg members 41 and the deck plate 43 are shown in FIG. 6. A step 44 between the top surface 45 and the leg attaching surface 46 provides for a recess which allows the hatch cover 11 to fit flush with the deck of the boat.

In the embodiment of FIG. 5, it is not necessary to utilize a strap or turnbuckle to secure the inventive platform 10 to the deck of the boat 12. In this embodiment, the lower end of the leg members 41 is provided with a threaded end 47 which fits through a mating hole 48 in the deck plate which hole 48 serves as an alignment and vertical support bushing for the legs 41. A threaded nut is used to attach the leg member to the deck plate. In order to preserve the ability to assembly and disassemble the inventive platform by hand, a unique feature is employed. A plastic tube 49 is heated to a point where the plastic becomes pliable. A nut 50 is then forced into the opening of the plastic tube 49 causing the diameter of the tube to fit over the hexagonal shape of the nut 50 which firmly attaches the nut 50 to the tube 49. The plastic tube 49 forms an elongated handle which a boater can easily grasp and firmly screw the nut 50 onto the threaded lower end 47 of the leg member 41. A unique collar 51 suspended from the bottom surface of the deck plate 43 captures the nut 50 when it is removed from the leg member 41 and retains the nut 50 within the collar 51 of the deck plate 43. In this manner, there is no chance of misplacing the nut 50.

In the embodiment of FIG. 4, the deck plate 43 includes the hole 48 for accepting the reduced diameter 52 of the leg member 41 at the bottom portion thereof. The reduced diameter portion 52 of the leg member 41 is not threaded. It mates closely with the hole 48 in the deck plate. The large flange portion 53 between the reduced diameter portion 52 and the main portion of the leg member 41 provides for a large seating area to assure a wobble free attachment to the deck plate 43 when nut 51 is firmly threaded onto threaded portion 47 of the leg 41. The embodiment of FIGS. 5 and 6 also provide for storage of the leg members 41 to the underside of the hatch cover 11 as shown in FIGS. 3 and 4.

Thus there is described a removable, lightweight but sturdy bow platform which is capable of being formed into a readily stowable form and which can be assembled, put in place on a boat, removed from the boat and disassembled by hand without the use of hand or power tools.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved.

I claim:

1. A platform for a boat, comprising:

a top planar member having a top surface and a bottom surface;

leg members extending downward from said bottom surface of said top planar member, said leg members being removably attached to said top member;

means for storing and securing said leg members when removed from said top member to said underside of said top member;

one or more mounting plates interconnected between said leg members and said top member, said one or more mounting plates being fixedly attached to said top member and said leg members being removably attached to said one or more mounting plates; and said attachment of said leg members to said one or more mounting plates comprising mating threads on said leg members and on said one or more mounting plates.

2. The apparatus of claim 1 wherein said leg members each comprise an elongated post member with screw threads at one end thereof and a flange between said screw threads and said post member.

3. A platform for a boat, comprising:

a top planar member having a top surface and a bottom surface;

leg members extending downward from said bottom surface of said top planar member, said leg members being removably attached to said top member;

means for storing and securing said leg members when removed from said top member to said underside of said top member; and one or more strap members for attaching said platform to said boat.

4. A platform for a boat, comprising:

a top planar member having a top surface and a bottom surface;

leg members extending downward from said bottom surface of said top planar member, said leg members being removably attached to said top member;

means for storing and securing said leg members when removed from said top member to said underside of said top member;

one or more strap members for attaching said platform to said boat; and wherein said top member comprises a hatch cover on said boat, said hatch cover being removably hinged to said boat.

5. The apparatus of claim 4 including a plurality of boat plates, said leg members being fittable to said boat plates when said platform is attached to said boat.

6. The apparatus of claim 5 wherein said boat plates include a hole therethrough, and said leg members include a cylindrical portion which is configured to snugly fit within said hole in said boat plate.

7. The apparatus of claim 6 wherein said leg members each include a flange adjacent to said cylindrical portion.

8. The apparatus of claim 7 wherein each of said leg members include a threshold portion at the end of said cylindrical portion.

9. The apparatus of claim 8 including a nut retained by said boat plate for connecting said leg members to said boat plates.

* * * * *